US008008590B2

(12) United States Patent
Chen et al.

(10) Patent No.: US 8,008,590 B2
(45) Date of Patent: Aug. 30, 2011

(54) ILLUMINATED KEY-PAD ASSEMBLY

(75) Inventors: Chao Chen, Waterloo (CA); Timothy Herbert Kyowski, Brantford (CA); Dennis J. Penner, Wellesley (CA)

(73) Assignee: Research In Motion, Waterloo, ON, CA (US)

( * ) Notice: Subject to any disclaimer, the term of this patent is extended or adjusted under 35 U.S.C. 154(b) by 0 days.

(21) Appl. No.: 12/685,106

(22) Filed: Jan. 11, 2010

(65) Prior Publication Data

US 2010/0108482 A1 May 6, 2010

Related U.S. Application Data

(63) Continuation of application No. 11/926,464, filed on Oct. 29, 2007, now Pat. No. 7,671,290.

(51) Int. Cl.
*H01H 9/00* (2006.01)

(52) U.S. Cl. ..... 200/314

(58) Field of Classification Search ..... 200/5 A, 200/5 R, 159 B, 293, 294, 295, 296, 302, 200/340, 243, 310–314, 341–345, 512–520; 362/85, 26, 30.87, 626; 341/31, 200, 340, 341/400, 708; 400/711
See application file for complete search history.

(56) References Cited

U.S. PATENT DOCUMENTS

| | | | | |
|---|---|---|---|---|
| 5,510,782 | A | 4/1996 | Norris et al. | |
| 5,635,927 | A | 6/1997 | Lin | |
| 6,545,232 | B1 * | 4/2003 | Huo-Lu | 200/5 A |
| 6,886,956 | B2 | 5/2005 | Parker et al. | |
| 7,335,843 | B2 * | 2/2008 | Chan et al. | 200/310 |
| 7,411,142 | B2 * | 8/2008 | Jung et al. | 200/314 |
| 2005/0068202 | A1 | 3/2005 | Shipman | |
| 2006/0181506 | A1 | 8/2006 | Fyke | |

FOREIGN PATENT DOCUMENTS

| | | |
|---|---|---|
| DE | 2737697 | 3/1978 |
| DE | 20201423 | 7/2002 |
| DE | 202004001350 | 4/2004 |
| EP | 0685860 | 12/1995 |
| EP | 1106419 | 6/2001 |
| EP | 1724800 | 11/2006 |
| EP | 1737010 | 12/2006 |
| EP | 1830123 | 9/2007 |
| WO | 2006117659 | 11/2006 |

(Continued)

OTHER PUBLICATIONS

European Patent Office, Extended European Search Report for EP Patent App. No. 07119553.1, Apr. 17, 2008.

(Continued)

*Primary Examiner* — Edwin A. Leon
(74) *Attorney, Agent, or Firm* — Borden Ladner Gervais LLP; Jeffrey W. Wong

(57) ABSTRACT

For a cell-phone or PDA, the rows of key-caps include respective light-strips, which pick up light from respective LEDs surface-mounted on the PCB. The light-strips are sandwiched between the key-caps and the key-switch actuators (whereby the light-strips move with the keys when the keys are depressed). Sockets for receiving the key-caps are co-molded to the light-strips. Sockets are provided in the resilient webs of the keys for receiving under-blocks co-molded to the light-strips.

17 Claims, 5 Drawing Sheets

FOREIGN PATENT DOCUMENTS

WO 2006138149 12/2006

OTHER PUBLICATIONS

United States Patent and Trademark Office, Office Action for U.S. Appl. No. 11/926,424, filed Jun. 1, 2009.
European Patent Office, Examination Report for EP Patent App. No. 07119553.1, Nov. 6, 2009.
European Patent Office, Examination Report for EP Patent App. No. 07119553.1, Mar. 30, 2010.
Canadian Intellectual Property Office, Office Action for CA Patent App. No. 2,639,368, Mar. 29, 2011.
European Patent Office, Extended European Search Report for EP Patent App. No. 11153236.2, Apr. 4, 2011.
European Patent Office, Extended European Search Report for EP Patent App. No. 11153235.4, Apr. 4, 2011.

* cited by examiner

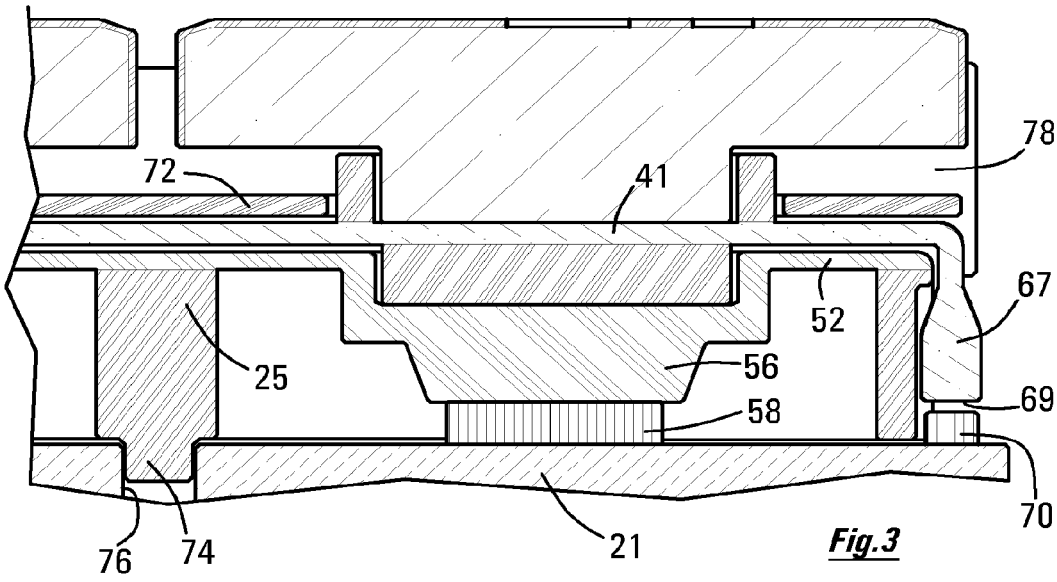
Fig.3
Fig.4
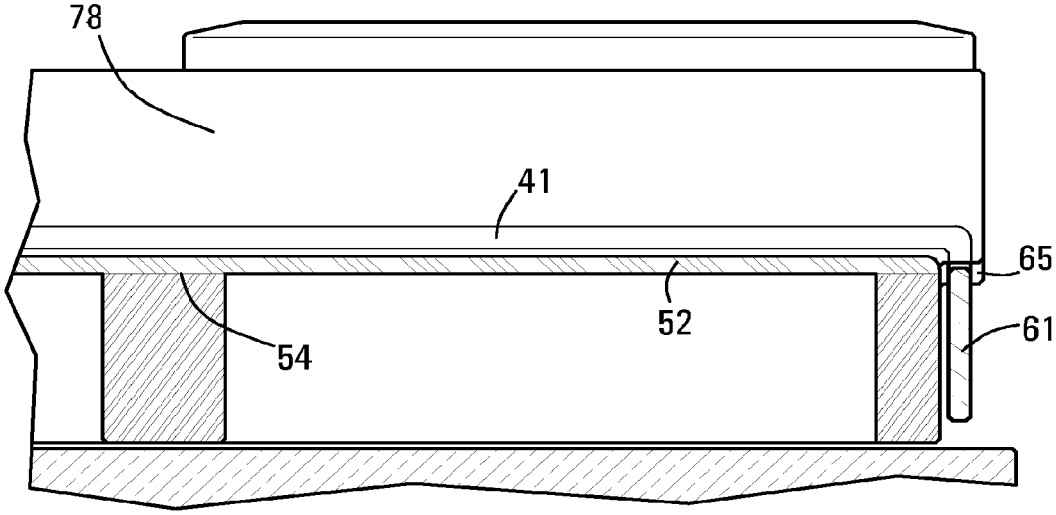

ILLUMINATED KEY-PAD ASSEMBLY

CROSS-REFERENCE TO RELATED APPLICATIONS

This application is a continuation of U.S. patent application Ser. No. 11/926,464, filed Oct. 29, 2007, which is incorporated herein by reference in its entirety.

FIELD OF THE DISCLOSURE

This technology relates to illuminated key-pads, especially of the kind as used in cell-phones, personal digital assistants (PDAs) and the like. Generally, such key-pads are illuminated by the use of transparent or translucent light-transmitting films or sheets, which receive light from a light emitting diode (LED) provided for the purpose, and powered by the battery in the PDA.

BACKGROUND OF THE DISCLOSURE

In traditional designs of illuminated key-pad units, the LED has been mounted in the key-pad unit itself, and has been connected to the main circuit board of the PDA by means of a flexible printed circuit (FCP) connector. In other designs, the light-transmitting film or light-guide has been placed underneath the whole key-pad unit; in these designs, in order for the light to reach the key-caps, the light had to pass through a number of components, whereby a significant proportion of the light was attenuated.

BRIEF DESCRIPTION OF THE DRAWINGS

By way of further explanation, an example of an illuminated key-pad unit for a PDA will now be described, with reference to the accompanying drawings, in which:

FIG. 3 is a cross-section on the line 3-3 of FIG. 2.

FIG. 4 is a cross-section on the line 4-4 of FIG. 2.

DETAILED DESCRIPTION OF PREFERRED EMBODIMENTS

Figure 1:
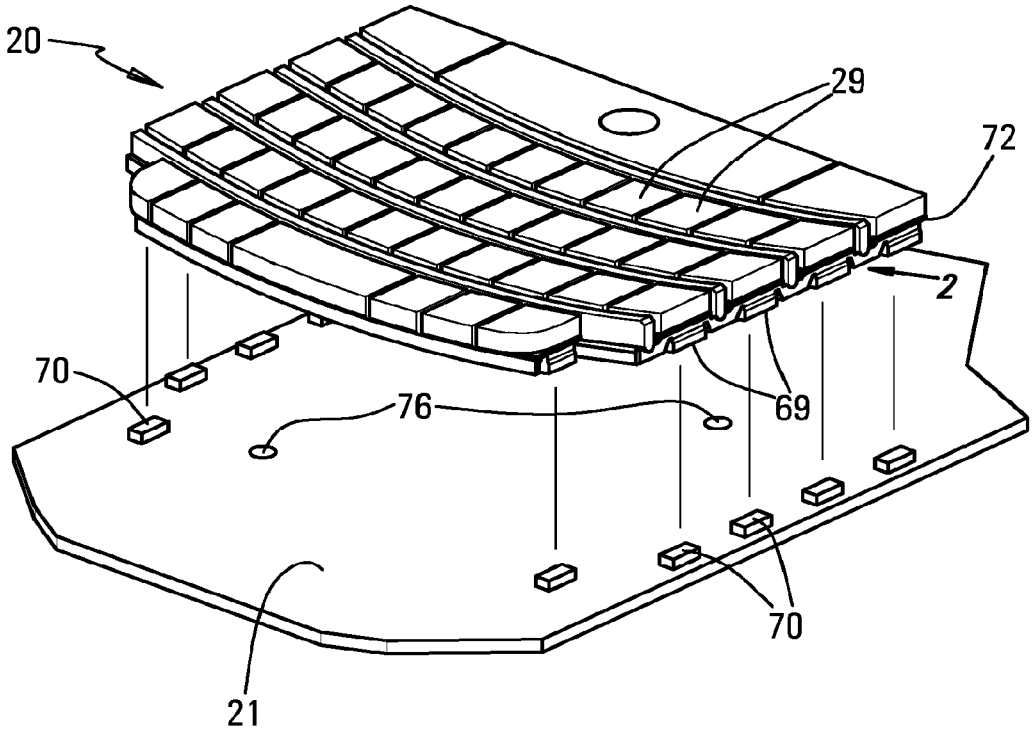
FIG. 1 is a pictorial view of an illuminated key-pad unit, shown in association with the circuit-board of the PDA in which the key-pad unit is to be fitted.
Figure 2:
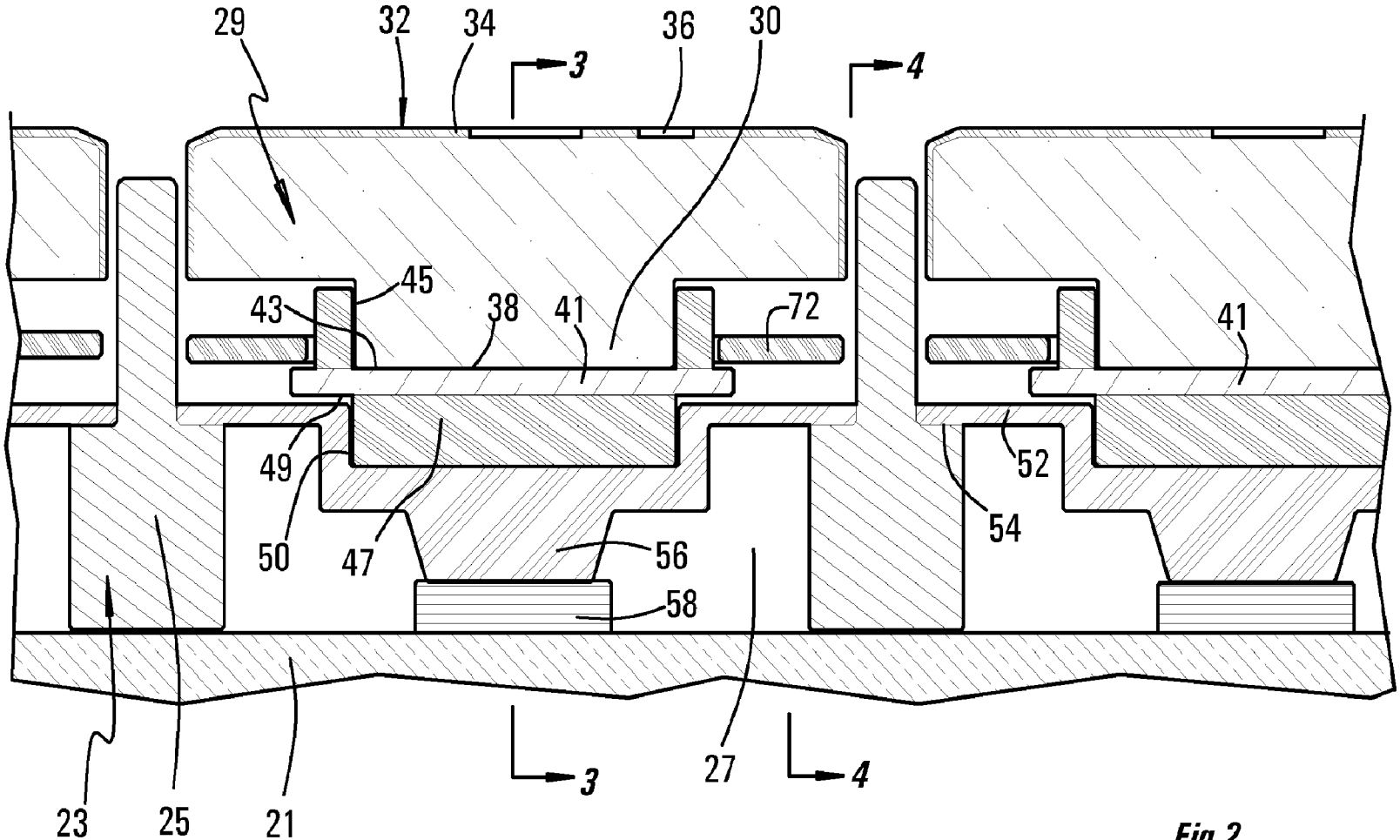
FIG. 2 is a sectioned-elevation on the line of the arrow 2 of FIG. 1.
Figure 5:
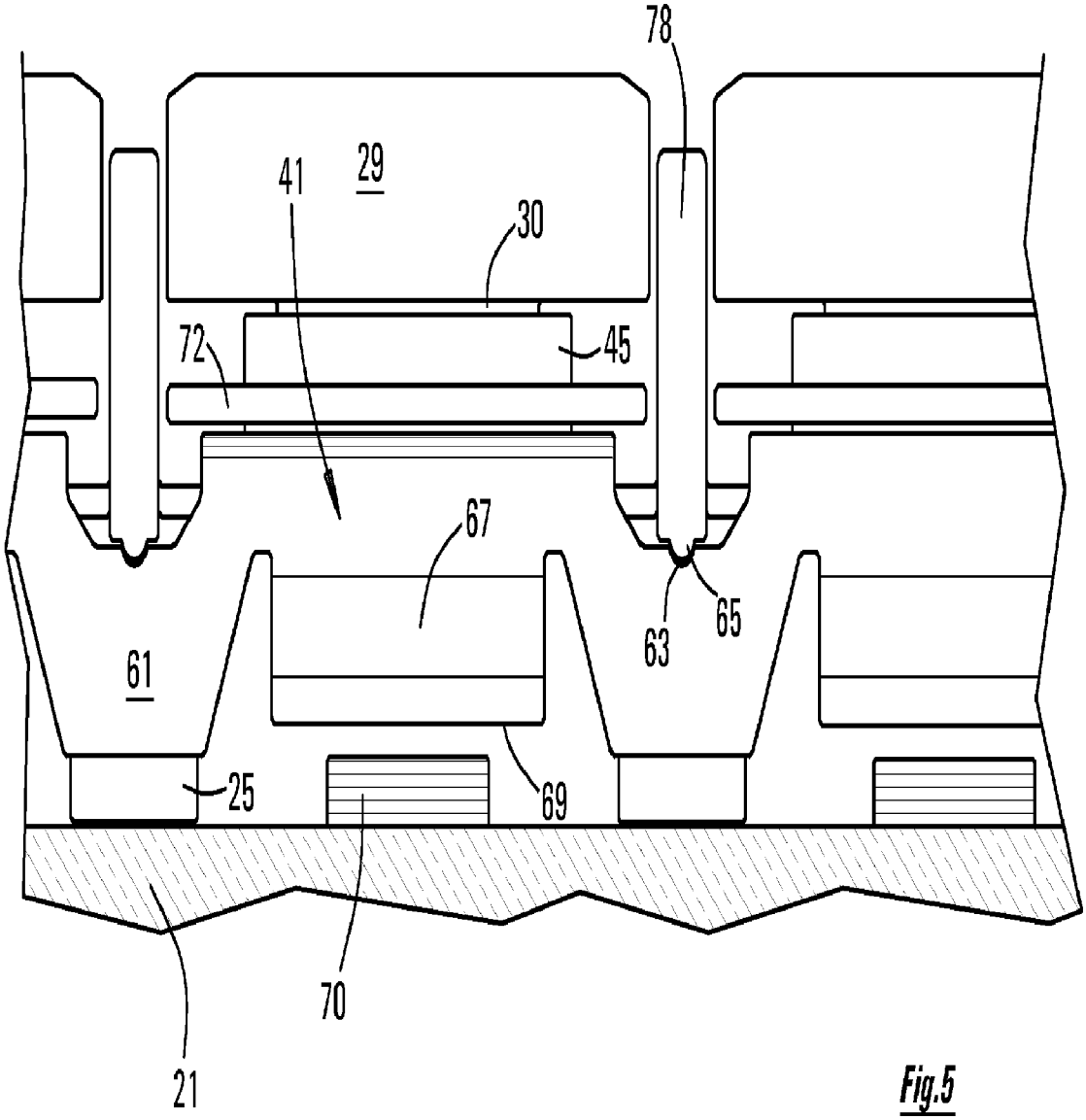
FIG. 5 is a side elevational in the direction of the arrow 2 of FIG. 1.

The physical features described herein, although shown or described in respect of just one exemplary structure, should be understood as being applicable also to other structures, or as being interchangeable with corresponding features of other structures, unless otherwise stated, or unless such would be understood to be physically impossible.

FIGS. 1-7 show an illuminated key-pad unit 20 that is designed for assembly to a printed circuit board (PCB) 21, for installation in a PDA.

The key-pad unit 20 includes a rigid plastic frame 23. The frame includes rails 25 which define spaces or pockets 27 between the rails. The pockets 27 correspond each to a particular key of the key-pad unit 20.

The key includes a key-cap 29, which is formed as a molding of transparent or translucent plastic. The key-cap molding includes an under-button 30, of the same material. The visible outer surface 32 of the key-cap 29 is provided with a mask or coating 34. Windows 36 formed in the coating 34 allow light to shine through the key-cap, to display the letter or numeral etc appropriate to that key.

Light is supplied to the under-surface 38 of the under-button 30 via a light-strip 41. The light-strip 41 comprises a thin film (of the order of e.g 0.4 mm thick) of transparent or translucent material, which transmits light received at one location of the light-strip 41 throughout the material. Thus, light emerges from the overface 43 of the light-strip 41 and is transmitted directly into the under-surface 38 of the under-button 30 of the key-cap 29, and out of the windows 36 in the coating 34 of the key-cap 29.

The under-surface 38 of the under-button 30 is glued to the overface 43 of the light-strip 41, both to physically secure the key-cap 29 to the light-strip 41, and to ensure efficient transmission of light therebetween.

The light-strip 41 is provided with button-receiving sockets 45, which are shaped to hold the respective key-caps 29 in a predetermined positional relationship with respect to the light-strip 41. The socket 45 is rectangular, and the under-button 30 is profiled to fit inside the hollow interior of the rectangle, whereby, when the under-button 30 is received in the socket 45, the key-cap 29 is thereby prevented from movement laterally and rotationally relative to the light-strip 41. This mechanical constraint of the key-cap 29 ensures that the key-cap is glued to the light-strip accurately in its correct predetermined position.

The button-receiving socket 45 also serves other functions. The walls of the socket 45, being of opaque material, prevent leakage of light sideways out from the under-button 30. Also, the walls of the socket 45, especially if coloured white, serve to reflect light back into the under-button, and hence into the key-cap, whereby the light shining through the windows 36 is all the brighter. Also, the walls of the socket 45 serve as a tray, to catch any (liquid) adhesive that might be squeezed out from between the under-surface 38 and the overface 43.

An under-block 47 is attached to the underface 49 of the light-strip 41. The under-block 47 is of opaque and reflective material, which serves to prevent leakage of light out underneath the light-strip 41, and to reflect light back into the light-strip.

Just as the under-button 30 resided in the button-receiving socket 45, so the under-block 47 resides in the block-receiving socket 50. The socket 50 is formed in the middle of a membrane or diaphragm or web 52. The web 52 is co-molded or bonded onto respective ledges 54 on the rails 25 of the frame 23.

The web 52 is of a flexible material such as silicone rubber. The webs have enough inherent stiffness to hold the keys, when not pressed, in their correct relationships and positions. Thus, the inherent stiffness of the web 52 is enough to hold the thickened actuator portion 56 of the web 52, underneath the block-receiving socket 50, clear of the key-switch 58 on the PCB 21. On the other hand, it is very easy for the user to exert enough downwards force on the key-cap 29 to depress the key, and thereby to bring the actuator 56 into contact with the key-switch 58. The force required to depress the key, however, is large enough that the person can feel a resistance to the pressure of their finger on the key.

In many previous designs of key-pad unit, an under-button of the key-cap has engaged directly into a socket formed in the flexible web. By contrast, in the present design, the under-button 30 of the key-cap engages the socket 45 attached on top of the light-strip 41, and the under-block 47 attached underneath the light-strip 41 engages the socket 50 formed in the web 52. In the present design, by contrast, the light-strip 41 is interposed between the key-cap 29 and the flexible web 52. As such, it will be understood that the light-strip 41 is now called upon to move (downwards), and to flex, somewhat, when the keys are depressed.

Thus, in the present design, the light-strip 41 should be flexible. But it is recognised that the light-transmitting material from which light-strips are typically made does have the desired degree of flexibility (that is to say, the ability to be flexed countless times without sustaining damage). In previous designs, the ability of the light-transmitting material to flex, and to move with the keys, has not been exploited, or not fully exploited.

Figure 6:
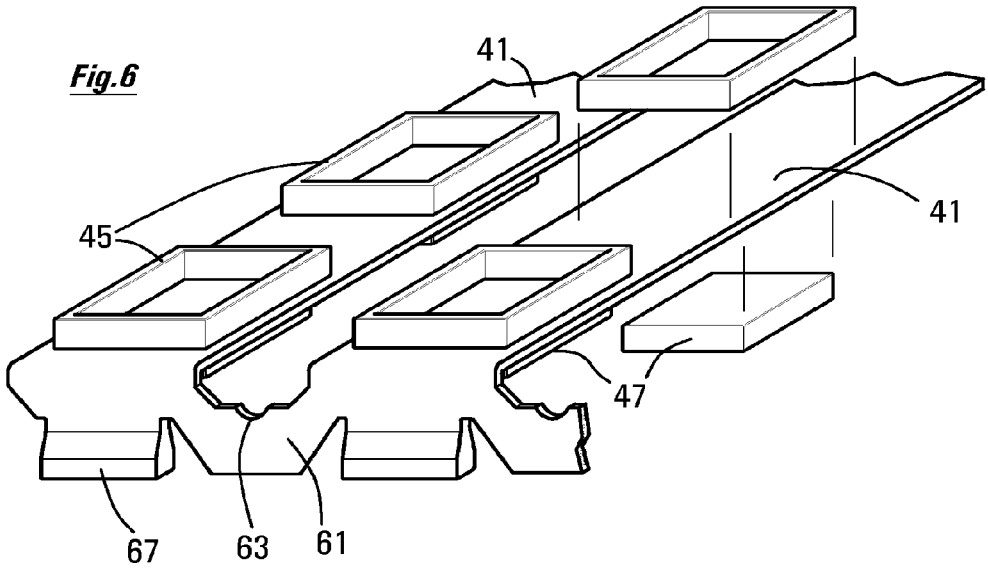
FIG. 6 is a pictorial view of (part of) a light-strip component of the illuminated key-pad unit shown in FIG. 1.
Figure 7:
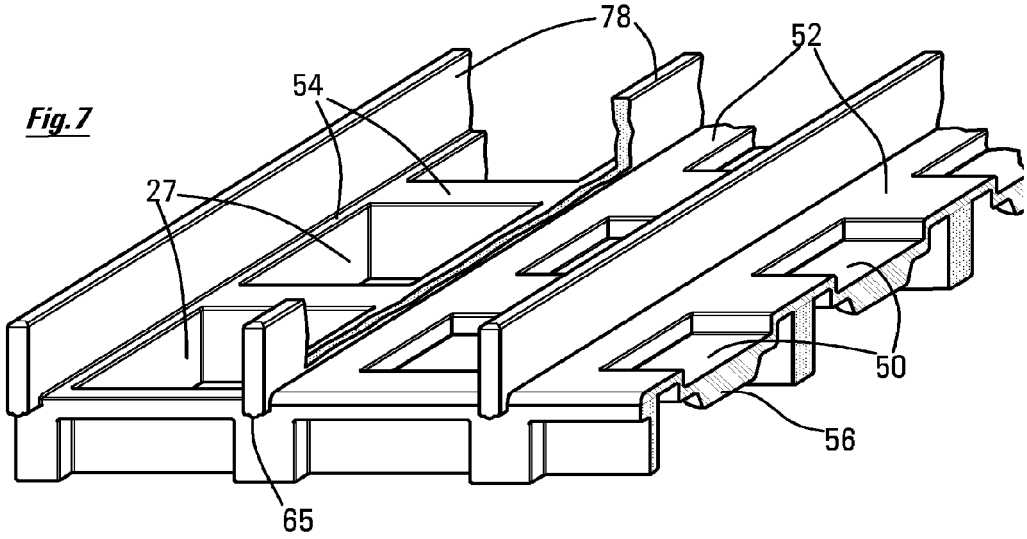
FIG. 7 is a pictorial view of (part of) a frame component of the illuminated key-pad unit shown in FIG. 1.

In a typical key-pad unit, there are between e.g fifteen and e.g thirty or more keys, arranged in e.g four or five rows. In the present design, there are as many light-strips 41 as rows of keys. As shown in FIG. 6, the several light-strips 41 are joined together at their ends, by means of linking straps 61. The straps 61 are formed on the ends of the light-strips 41, and may be regarded as joining the rolled-over ends of the light-strips.

The straps 61 are formed with respective notches 63, which engage underneath respective tenons 65 that are molded into the frame 23. Thus, for assembly, the straps 61 are stretched over, and snap underneath, the tenons 65.

Between the straps 61, the rolled-over ends of the light-strips 41 are formed with light-catchers 67. These light-catchers 67 comprise thickened areas of the light-strip material. The designer arranges that the respective under-faces 69 of the light-catchers 67, when the key-pad unit 20 is assembled to its PCB 21, lie positioned directly over respective light-emitting-diodes 70 attached to the PCB 21. Thus, light enters the light-strips 41 from the LEDs via the respective light-catchers 67.

The several light-strips 41 preferably are formed from a single flat sheet of light-transmitting material, in which the form of the light-strips is stamped out. The form of the linking-straps 61 is provided also by the stamping. For co-molding the button-receiving sockets 45, and the under-blocks 47, the sheet of light-transmitting material is laid in the mold, and then the sockets and blocks are formed by compression-molding. Preferably, the stamping of the sheet is done after the items have been co-molded onto the sheet. The light-catchers 67 also can be co-molded onto the sheet, preferably using clear or transparent rubber material.

As shown, the light-catchers 67 are somewhat thicker than the light-strips themselves. Thus, the light-catcher serves as a collecting hood, for collecting light from the LED. Typically, the light-catchers 67 would be one mm thick, where the light-strips 41 are thinner—typically less than 0.4 mm thick, down to about 0.1 mm thick.

The key-pad unit 20 comprises the several key-caps 29, the linked-together light-strips 41, the frame 23 with its co-molded webs 52, and a light-shielding sheet 72, This key-pad unit 20 can be simply lowered into position upon the PCB, without the need for complex physical or electrical connections.

The light-shielding sheet 72 inhibits light from leaking out into the spaces between the keys. It is preferably made of strips of black plastic film, with cut-outs for the under-buttons 30, disposed respectively along the lengths of the rows of keys.

The LEDs 70 are surface-mounted devices, SMDs, which are simply and directly connected to the PCB 21. There is no expensive need for the LEDs to be furnished with e.g FPC connectors. The point is emphasised that the illuminated key-pad unit 20 is fully functional, with respect to the PCB 21, simply upon being placed in close proximity to the PCB, both as to actuating the PCB key-switches and as to receiving light for illumination. The key-pad unit is a self-contained sub-assembly, which can be finish-manufactured prior to being placed over the circuit-board during final assembly of the PDA.

The designer preferably should see to it that each light-strip 41 has its own respective LED 70; and indeed has its own respective pair of LEDs, one at each end of the light-strip. It will be understood that the LEDs, arranged thus, can be actuated other than in unison. Because the light-strips 41 are illuminated each by its own (pair of) LEDs, the different rows of keys can be illuminated e.g in patterns or cascades, and can be of different colours. Alternatively, especially in cases where the number of keys is small, it can be arranged that all the individual keys have their own respective individual light-strips, and their own respective LEDs.

Having the light-strips 41 in direct contact with the key-caps 29 means that the available light is used very efficiently: thus, the illumination can be brighter than has been the case with previous illuminated key-pads; or alternatively the electrical (battery) power needed to illuminate the keys can be significantly reduced; or the illumination can be maintained for a longer period of time.

The SMT LEDs, as shown, shine upwards with respect to the PCB. Thus, the light-catchers 67 have to be angled downwards in order to receive the light. In some installations, it is preferred to use side-shining SMT LEDs, whereby the light-strips do not have to be wrapped over the edge of the frame. Side-shining LEDs are generally more costly than top-shining, but the light-strips are simplified.

Upon assembly of the key-pad unit 20 to the PCB 21, dowels 74 underneath the rails 25 of the frame 23 engage corresponding holes 76 in the PCB 21, for location purposes. Apart from that, no other physical or electrical or light-transmitting connections are required between the key-pad unit 20 and the PCB 21.

The frame 23 is of rigid plastic, and preferably is black in colour for light-shielding effect. The rails 25 that run width-wise across the PDA preferably, as shown, can be surmounted by rulers or dividers 78, which lie between adjacent rows of keys. It will be understood that dividing the rows of keys by a non-depressible ruler can be of considerable advantage to the user or operator of the PDA key-pad. The rulers 78 lie between, and serve to separate, the light-strips 41. The rulers 78 may be chrome-plated, or decorated with NCVM (non-conductive vapour metallization).

The "feel" of the key, when it is pressed, is important. The under-block 47 and the rectangle of the button-receiving socket 45 serve to stiffen the flexible light-strip 41 in the region of the key, for a good key feel. Also, the actuator 56 between the key-cap 29 and the key-switch 58 is important as regards the feel of the key. Because the actuator 56 is a thick mass, but is made of soft flexible material, the key feels firm enough, but yet there is no discernible bottoming of the key. Bottoming has a bad feel, and also can permit damage e.g to the PCB key-switch caused by overpushing.

To improve the feel of the keys, also the key-switches 58 preferably are slightly pre-loaded by the respective actuators 56, e.g by up to 0.15 mm of interference. Interference is preferred over a gap between the actuator and the key-switch, not only because lost travel would have a bad feel, but to supplement the firmness with which the key is held in its nominal position, when not depressed.

Co-molding the light-strips with the sockets and blocks permits or enables a combination of material properties. The light-strips, being attached between the key-caps and the actuators, need to be flexible enough to travel downwards, with the keys, when the keys are depressed. The light-strips 41 should also be flexible enough that when one of the keys is depressed, the keys adjacent to it in the row are not dragged down with it.

Terms of orientation, such as "above", down", "left", and the like, when used herein are intended to be construed as follows. When the terms are applied to an apparatus, the apparatus is distinguished by the terms only if there is not one single orientation into which the apparatus (or an image of the apparatus) can be placed, in which the terms can be applied consistently.

The numerals used in the drawings may be collated as:

20 key-pad unit
21 circuit-board PCB
23 rigid plastic frame
25 rail
27 space or pocket
29 key-cap
30 under-button
32 visible outer surface
34 mask or coating
36 window
38 under-surface of under-button 30
41 light-strip
43 overface of light-strip 41
45 button-receiving socket
47 under-block
49 underface of light-strip 41
50 block-receiving socket
52 resilient membrane, diaphragm, or web
54 ledge
56 actuator
58 PCB key-switch
61 linking strap
63 notch
65 tenon
67 light-catcher
69 under-face of light-catcher 67
70 light-emitting diode LED
72 light-shielding sheet
74 dowel
76 dowel-hole
78 ruler The scope of the patent protection sought herein is defined by the accompanying claims.

What is claimed is:

1. An illuminated key-pad unit comprising:
a set of depressible keys, the keys including respective key-caps;
a flexible web structure including block sockets; and
at least one light strip including under-blocks to engage the block sockets and a set of key-cap sockets, located on a top surface of the light strip, to engage the key caps.

2. The key-pad unit of claim 1 wherein the at least one light strip is of transparent or translucent light transmitting material.

3. The key-pad unit of claim 2 wherein the at least one light strip radiates light from an overface of the light strip.

4. The key-pad unit of claim 3 wherein the overface is in direct contact with an under surface of each key cap.

5. The key-pad unit of claim 2 wherein the at least one light strip is flexible.

6. The key-pad unit of claim 1 wherein the keys are arranged in a plurality of rows of keys, each row of keys having a corresponding light strip, the corresponding light strips connected via respective linking strips.

7. The key-pad unit of claim 6 wherein the linking strips are formed with notches which are hooked under tenons formed in a base frame of the unit.

8. The key-pad unit of claim 7 wherein the at least one light strip includes light catchers at each end.

9. The key-pad unit of claim 1 wherein each of the respective key-caps includes an over-surface having a window displaying a key-identification marking.

10. The key-pad unit of claim 1 wherein each key-cap is urged by the web structure into a respective rest position whereby each key-cap can be depressed against the web structure.

11. An illuminated key-pad comprising:
a frame;
a set of keys assembled in at least two rows and mounted on the frame; and
at least two light strips disposed along the at least two rows of keys, the at least two light strips including a respective overface;
wherein the at least two light strips are linked at their ends by respective linking straps;
whereby the linking straps are formed with notches hooked under tenons formed in the frame.

12. The key-pad of claim 11 wherein the at least two light strips are made of a transparent or translucent material.

13. The key-pad of claim 11 further comprising a flexible web structure including block sockets.

14. The key-pad of claim 11 wherein:
each key in the set of keys includes a key-cap;
each key-cap including a visible over-surface and a non-visible under-surface;
whereby the overface of one of the light strips is in a face-to-face and a direct light-transmitting relationship with the under-surface of each of the key-caps.

15. The key-pad as claimed in claim 14, wherein the overface of each light-strip is in direct touching contact with the under-surface of each of the key-caps.

16. The key-pad as claimed in claim 14, wherein:
each key-cap is provided with a respective under-button; and
each of the light strips including a set of button-receiving sockets adapted to engage the respective under-buttons;
such that each button-receiving socket is arranged to position the respective under-button laterally and rotationally with respect to each light strip; and
each button-receiving socket having walls of opaque material to reflect light back into the respective under-button of each key-cap.

17. The key-pad as claimed in claim 16, wherein each of the set of button-receiving sockets is bonded to the overface of the respective light strip.

* * * * *

UNITED STATES PATENT AND TRADEMARK OFFICE

CERTIFICATE OF CORRECTION

PATENT NO. : 8,008,590 B2
APPLICATION NO. : 12/685106
DATED : August 30, 2011
INVENTOR(S) : Chao Chen, Timothy Herbert Kyowski and Dennis J. Penner It is certified that error appears in the above-identified patent and that said Letters Patent is hereby corrected as shown below:

On the title page, in field (73) Assignee, insert --Limited-- after "Research In Motion".

Signed and Sealed this
Twenty-fourth Day of January, 2012

David J. Kappos

David J. Kappos
*Director of the United States Patent and Trademark Office*